United States Patent [19]

Pratt

[11] 4,239,715

[45] Dec. 16, 1980

[54] METHOD FOR MANUFACTURING AN ELONGATED STRIP BEARING

[75] Inventor: George C. Pratt, Chorleywood, England

[73] Assignee: The Glacier Metal Company Limited, Middlesex, England

[21] Appl. No.: 847,046

[22] Filed: Oct. 31, 1977

Related U.S. Application Data

[63] Continuation of Ser. No. 707,211, Jul. 21, 1976, abandoned, which is a continuation of Ser. No. 605,207, Aug. 15, 1975, abandoned, which is a continuation of Ser. No. 217,302, Jan. 12, 1972, abandoned.

[30] Foreign Application Priority Data

Jan. 13, 1971 [GB] United Kingdom ..... 1611/71

[51] Int. Cl.[2] ..... B28B 1/08; B05D 3/02

[52] U.S. Cl. ..... 264/70; 264/112; 264/120

[58] Field of Search ..... 264/112, 120, 70

[56] References Cited

U.S. PATENT DOCUMENTS 2,962,785 12/1960 Young ..... 425/456

3,405,206 10/1968 Abell et al. ..... 264/112

*Primary Examiner*—Donald J. Arnold

*Assistant Examiner*—James R. Hall

*Attorney, Agent, or Firm*—Burns, Doane, Swecker & Mathis

[57] ABSTRACT

This invention is a method for making a plain bearing in the form of a strong backing strip carrying a bearing lining. The lining is formed from powder material drawn from the bottom of a container by the strip moving past it, and a downstream wall of the container is vibrated towards and away from the strip to compact the powder layer.

4 Claims, 3 Drawing Figures

METHOD FOR MANUFACTURING AN ELONGATED STRIP BEARING

This is a Continuation of the inventor's U.S. application Ser. No. 707,211, filed July 21, 1976, now abandoned, which in turn is a Continuation of application Ser. No. 605,207 filed Aug. 15, 1975, now abandoned, which in turn is a Continuation of U.S. application Ser. No. 217,302 filed Jan. 12, 1972, now abandoned.

The present invention relates to the manufacture of composite, or multi-layer strip material, for example for fixedly depositing a substance in powder form on a rigid backing, for example, a metallic or plastics powder on a rigid strip formed from a metal, metal alloy or plastics composite, to form a plain bearing material.

According to one aspect of the present invention in such a method relative movement takes place between a strip constituting one layer and a container of material in powder or granular form to constitute another layer, the powder material being carried by the strip from the container and being subjected to the action of a compacting device which acts repeatedly towards the strip.

The rate of action of the compacting device may be fast compared with the speed of relative movement.

In a preferred embodiment of the invention, the bottom edge of the compacting member is bevelled to control accurately the flow of the powder to the strip, while obviating the uneven effect that could arise through sticking and dragging while compacting the powder on the moving strip with a flat or parallel edge. However, there may be a small flat parallel with the strip at the edge of the bevel.

The amplitude of movement of the compacting member will control the thickness of the layer of powdered material, and its relatively high frequency will keep the layer of uniform size and composition, and will fix it on the strip as it leaves the container. Heat treatment may be used.

The invention may be carried into practice in various ways and one embodiment will be described by way of example with reference to the accompanying drawings, in which.

Figure 1:
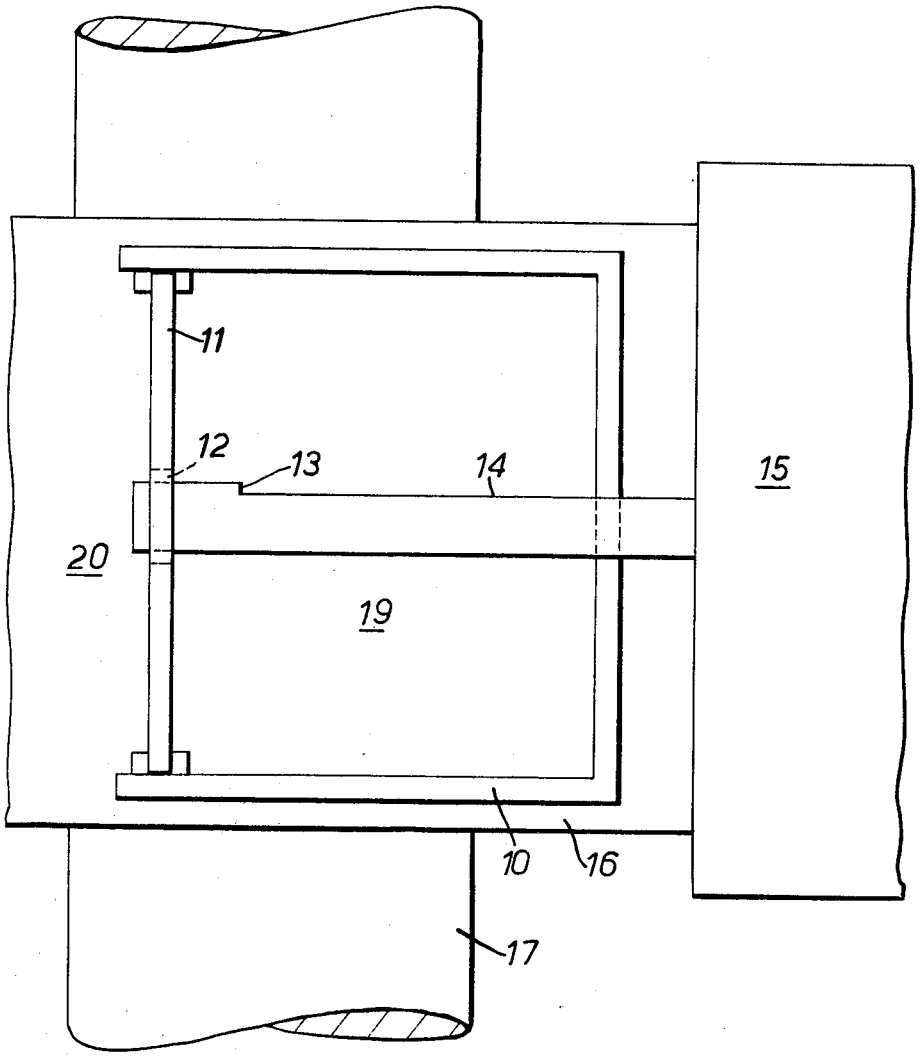
FIG. 1 is a plan view of part of a multi-layer strip manufacturing apparatus.
Figure 2:
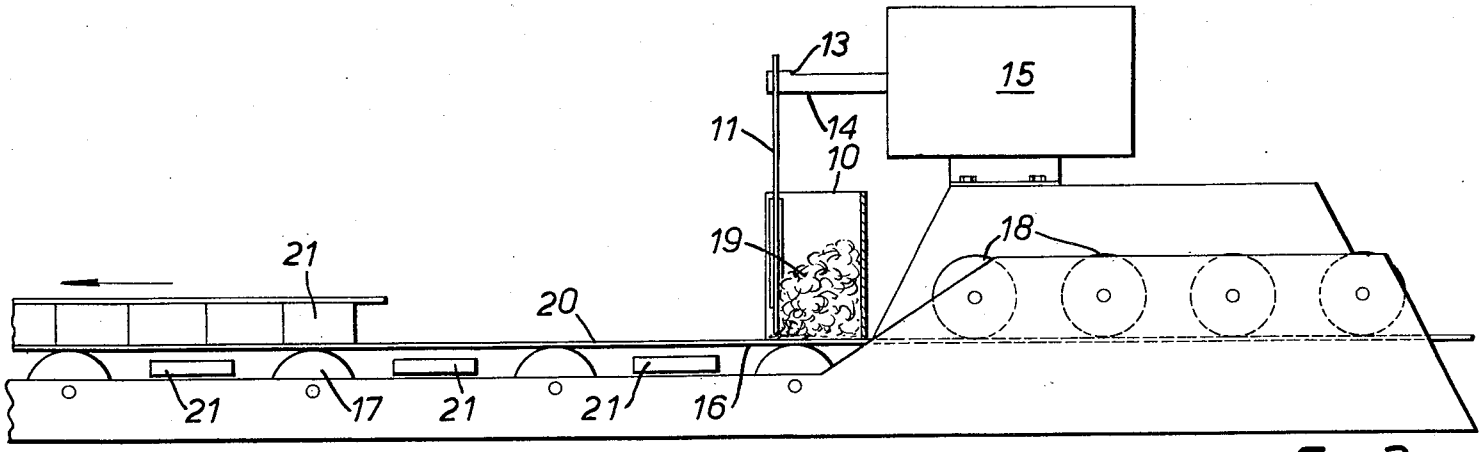
FIG. 2 is a side elevation of the apparatus.

A backing strip 16 forms a first layer of a bearing being formed. The backing strip which is of steel in the apparatus being described, but could be of other metals, alloys, or plastics materials, is driven longitudinally continuously by power driven lower rollers 17 and top sprung rollers 18 past the bottom of a hopper 10 containing the plastics powder 19 which in the present embodiment, is to form the second layer.

The moving backing strip 16 closes the bottom of the hopper 10 except at the downstream end, where the wall 11 of the hopper can reciprocate vertically, so that it acts alternately to press down on the powder on the strip and compact it, and to leave a larger area for powder to pass between its under edge and the strip. The vertical movement will be of the same order as the thickness of the compacted powder layer 20 and in the example being described is 0.075".

The frequency of reciprocation is related to the linear speed of the strip 16 and according to one empirical rule the frequency is about 480 per foot. Thus for a strip speed of 2 feet per minute the frequency would be 960 per minute, and at a speed of 5 feet per minute the frequency would be 2400 per minute.

This is achieved by relating the speed of a motor 15 driving the plate through an eccentric cam 13 on its shaft 14 as shown in FIG. 1, which also shows vertical guides for the wall 11. The wall 11 is likely in practice to move in a slightly arcuate path as seen looking in the direction of movement, rather than absolutely vertically.

The effect is to regulate closely the amount of powder carried on unit length of the strip 16 of the desired width, and to compact it as it leaves the hopper.

The multi-layer bearing then passes between upper and lower heaters 21 for curing of the plastic or other heat treatment, and thence to rollers (not shown) for further bonding.

Figure 3:
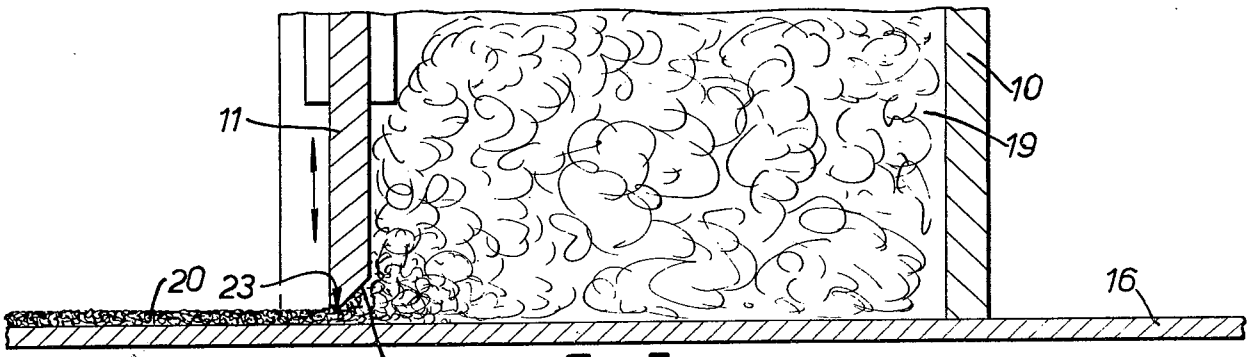
FIG. 3 is a detail of FIG. 2 to an increased scale.

FIG. 3 shows the preferred section of the bottom of the wall 11 as a bevel or chisel 22 at about 45°, leading to a short flat 23 in a horizontal plane. For some applications, a sharp edge without the flat 23 is preferred.

If the lowest point of the wall during a vibration of 0.075" is 0.009" above the top surface of the strip 16, the powder layer would vary between 0.009" and 0.084" in thickness, and after a rolling operation this could be made to give a layer thickness of about 0.012".

What I claim as my invention and desire to secure by Letters Patent is:

1. A method of making a multi-layered elongated strip bearing, one layer of said bearing being defined by a solid backing strip and another layer thereof being defined by a layer of particulate powder bearing material bonded to said backing strip, said method comprising the steps of:

A. providing a container having vertical side walls and an open bottom, one of said side walls defining a vertically reciprocating downstream wall of said container, said downstream wall having a bottom edge which is beveled upwardly toward the inside of said container, B. maintaining a supply of said powder within said container in direct contact with a vertical inside wall of said downstream wall to a height disposed above an upper end of a vertical reciprocation stroke of said downstream wall, C. feeding a solid backing strip beneath said container so that some of said powder is deposited onto said backing strip, D. advancing said powder-carrying backing strip toward said downstream wall and beneath said bottom edge, E. vertically reciprocating said downstream wall as said strip passes therebeneath such that:

i. at the top of said reciprocation stroke said bottom edge is out of contact with powder on said strip and exposes for uninhibited downstream travel a height of uncompacted powder on said backing strip extending from said strip to said bottom edge so that such uncompacted powder moves downstream to a position beneath said bottom edge, and ii. at the bottom of said reciprocation stroke said bottom edge is disposed at a predetermined location above said backing strip and compacts powder disposed therebeneath, and F. thereafter heating the compacted powder material and backing strip to bond together particles of said powder and bond such particles to said backing strip.

2. A method according to claim 1, wherein said downstream wall is reciprocated at a frequency of at least ten strokes per foot of travel of said strip.

3. A method according to claim 1, wherein said step of paragraph A includes providing a horizontal surface portion which is continuous with, and projects downstream from, a lowermost end of said beveled bottom edge.

4. A method according to claim 1, wherein said step of paragraph A comprises reciprocating said downstream wall at a rate which is related to the speed of travel of said backing strip to control the amount of powder applied to said backing strip.

* * * * *